US007040878B2

(12) United States Patent
Denk et al.

(10) Patent No.: US 7,040,878 B2
(45) Date of Patent: May 9, 2006

(54) ECCENTRIC SCREW-TYPE PUMP

(75) Inventors: Reinhard Denk, Muehldorf (DE); Bernhard Murrenhoff, Buchbach (DE); Christopher Martin Gwalchmai, Kraiburg/Inn (DE); Johann Kreidl, Waldkraiburg (DE)

(73) Assignee: NETZSCH-Mohnopumpen GmbH, Waldkraiburg (DE)

( * ) Notice: Subject to any disclaimer, the term of this patent is extended or adjusted under 35 U.S.C. 154(b) by 0 days.

(21) Appl. No.: 10/371,200

(22) Filed: Feb. 24, 2003

(65) Prior Publication Data

US 2004/0028546 A1 Feb. 12, 2004

(30) Foreign Application Priority Data

Feb. 22, 2002 (DE) ..... 102 07 483

(51) Int. Cl.
*F01C 1/10* (2006.01)
*F03C 2/00* (2006.01)
*F04C 18/00* (2006.01)

(52) U.S. Cl. ..... 418/48; 417/205; 464/157

(58) Field of Classification Search ..... 418/48; 417/205; 464/157
See application file for complete search history.

(56) References Cited

FOREIGN PATENT DOCUMENTS

| | | | | |
|---|---|---|---|---|
| DE | 6916941 A | * | 4/1969 | ..... 418/48 |
| DE | 1553201 | | 2/1971 | |
| DE | 2316127 A | * | 10/1974 | |
| DE | 0037294 B | * | 7/1983 | ..... 418/448 |
| DE | 44 08 659 A | | 9/1999 | |
| EP | 0657649 | | 12/1996 | |
| JP | 07 223718 A | | 12/1995 | |
| JP | 07328698 A | * | 12/1995 | |
| JP | 10077974 A | * | 3/1998 | |
| JP | 10 077974 A | | 6/1998 | |
| JP | 2000145660 A | * | 5/2000 | |
| JP | 2001271764 A | * | 10/2001 | |

* cited by examiner

*Primary Examiner*—Theresa Trieu
(74) *Attorney, Agent, or Firm*—Crowell & Moring LLP

(57) ABSTRACT

An eccentric screw-type pump has a pump section with a tubular pump casing, a stator cladding and a pump cavity (30) configured in correspondence with a double-thread or multi-thread screw. A screw-type rotor is connected to a driving shaft via a flexible shaft. The flexible shaft is connected at its two ends via rigid coupler elements to the rotor and the driving shaft, and is surrounded by a preloaded coaxially disposed screw.

16 Claims, 1 Drawing Sheet

ECCENTRIC SCREW-TYPE PUMP

BACKGROUND OF THE INVENTION

The present invention relates to an eccentric screw-type pump consisting of a pump section with a tubular pump casing, with a stator cladding including a pump cavity formed in correspondence with a two-thread or multithread screw, with a charge casing and with a drive system and with a screw-type rotor that is connected to a driving shaft by way of a flexible shaft, wherein the flexible shaft is connected by its two ends via rigid coupler elements to the rotor and the driving shaft.

EP 0 657 649 B1 discloses a pump structure in which a flexible shaft presents a long radial distance from the intake housing. In this case, the flexible shaft is connected to the driving shaft by a screw connection and to the rotor head via a coupler transmitting the torque via a pin. The pin is covered by a coupling sleeve adapted to be pushed over the rotor head. The product supplied to the intake housing is caused to arrive in the rotor/stator zone merely by the introduced pressure and by the suction power of the pump.

DE 15 53 201 A1 discloses an eccentric screw-type pump wherein a rigid connecting shaft is disposed between a screw-type rotor and a driving shaft. A driving sleeve is seated on the drive-side end of the connecting shaft for holding a non-supported screw and causing this screw to rotate. The screw obtains a certain running smoothness and inherent stability by the provision that it is permanently supported on the inner wall on the intake housing.

SUMMARY OF THE INVENTION

The present invention is now based on an objective of improving an eccentric screw-type pump with a flexible shaft with a view to the product intake.

This objective has been achieved in accordance with the present invention by surrounding the flexible shaft with a preloaded coaxially disposed screw.

The present invention starts out from the discovery that, as the viscosity of the product to be delivered increases, it becomes more and more necessary to create an additional pumping effect in the charge casing of the pump. Forced delivery by way of an additional screw has so far not been known in conjunction with the application of flexible shafts. The present invention also, however, solves the problem of an unnecessary weight load with an appropriate stability of the screw. It was a surprise to find that, depending on the structural dimensions, the screw may be formed with very thin and narrow material if the material is maintained in a certain pre-stressed condition. This preload expresses itself in the tensioning distance of the screw, which corresponds to 0.05 to 0.5 times the rotor diameter. The preload is applied to the screw by subjecting the screw to positive deformation by an amount corresponding to the aforementioned tolerance range. This deformation is realized by mechanical stretching of the screw. To this end, the screw is fixed on one side of the flexible shaft or on the coupler element, respectively, that is provided on this side, and is then fastened on the opposite side after spreading.

In accordance with another inventive aspect of the present invention, the screw may also be subjected to a negative preload by upsetting the screw. The amount by which the screw is upset comes under the same tolerance range as that applicable to positive pre-straining. Due to the preload of the screw, the screw body remains dimensionally stable during the rotational motion while the bending rod is deformed or twisted, respectively, in correspondence with the eccentricity generated by the rotor. The weight savings achieved by the saved material for the screw becomes evident as a positive influence on the reduction of wear on all rotating parts and the parts connected to them.

Another inventive aspect of the invention involves the connection of the screw to the flexible shaft and/or the driving shaft. In this manner, the screw, which is provided, for example, with a ring welded to it on both sides, may be connected by adjusting screws in a frictional or a positive manner.

BRIEF DESCRIPTION OF THE DRAWINGS

Other objects, advantages and novel features of the present invention will become apparent from the following detailed description of the invention when considered in conjunction with the accompanying drawings.

The sole FIGURE illustrates a longitudinal section taken through an eccentric screw-type pump in accordance with the present invention.

DETAILED DESCRIPTION OF THE DRAWING

Figure 1:
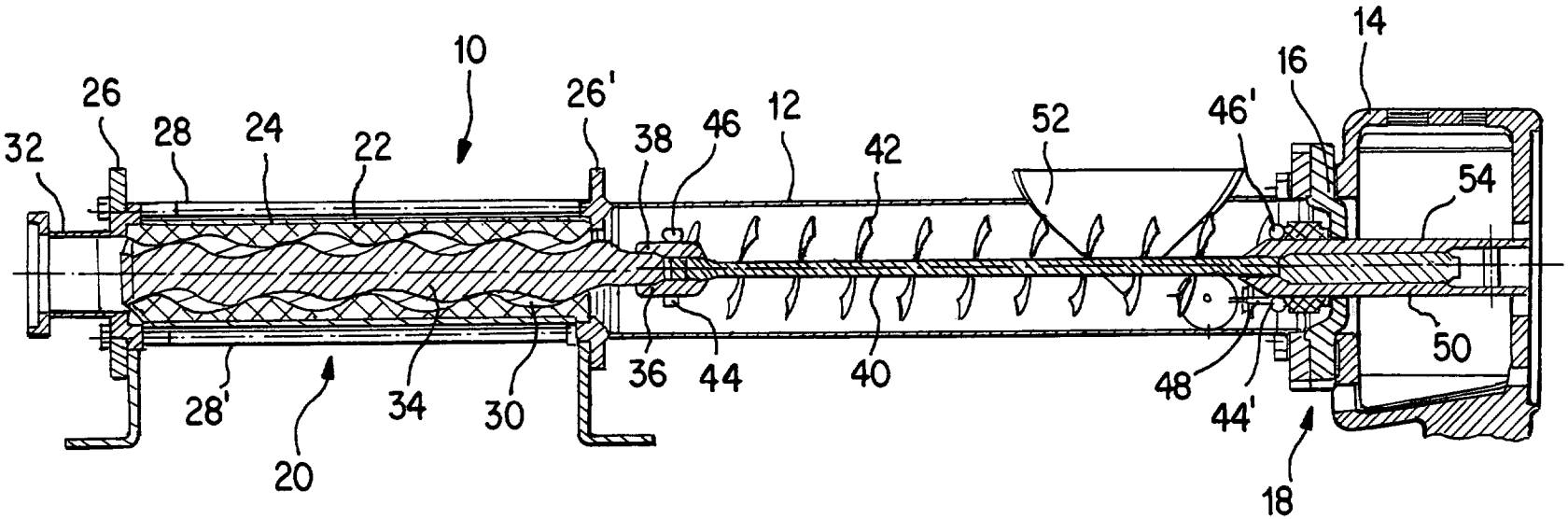

The pump illustrated in FIG. 1, includes a pump section 10, a charge casing 12 and a housing 14 in or on which a seal 16 and a support 18 are mounted or accommodated. A stator 20 is constituted by a tubular pump casing 22 and a stator cladding 24. The stator is clamped between two flanges 26, 26' by screws 28, 28'. The stator cladding 24 is provided with a two-thread screw-type pump cavity 30.

At the pressure-side end of the stator 20, a flange 26 is provided with a fitting 32. At the suction-side end of the rotor 34, whose rotor head 36 projects into a charge casing 12, a coupler element 38 ensures the rigid connection with the flexible shaft 40. A screw 42 extends coaxially relative to the bending rod 40, which maintains a radical spacing from both the flexible shaft 40 and the inner side of the pump casing. A connection for rotation is established between the screw 42, by way of the two annular disk-shaped elements 44, 44' welded to either end of the screw, via the coupler elements 38, 48 and the flexible shaft 40, to which end the annular elements 44, 44' are provided with screws 46, 46'. These screws 46, 46' constitute a frictional or also a positive connection to the coupler elements 38, 48.

The coupler element 48 is of a tubular configuration and accommodates a tensioning element 50 in its cavity, by way of which the coupler element 48 is connected for rotation with the flexible shaft. The product arrives via a charging funnel 52 in the charge casing 12. In the illustrated embodiment, the material of the screw is a flat material; if necessary, a round material may also be used instead. It is equally possible to employ different materials such as different steels for different applications. The positive preload expresses itself in the tensioning distance of the screw 42, which corresponds to 0.05 to 0.5 times the rotor diameter in the case of rotors having diameters from 15 to 180 mm.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Eccentric screw-type pump comprising a pump section having a tubular pump casing, a stator cladding and a pump cavity configured in correspondence with a double-thread or multi-thread screw;

a charge casing;

a drive system; and a screw-type rotor operationally connected to a driving shaft via a flexible shaft;

wherein said flexible shaft is connected by two ends thereof via rigid coupler elements to said rotor and said driving shaft, and said flexible shaft is surrounded by a preloaded coaxially disposed screw, and a tensioning mechanism operatively associated with said screw such that a tensioning distance of said screw corresponds to 0.05 to 0.5 times a diameter of the rotor.

2. Eccentric screw-type pump according to claim 1, wherein said screw is maintained under a positive preload in the form of a stretched state.

3. Eccentric screw-type pump according to claim 1, wherein said screw is maintained under a negative preload in the form of an upset state.

4. Eccentric screw-type pump according to claim 1, wherein said screw includes an annular element on at least one end thereof.

5. Eccentric screw-type pump according to claim 4, wherein said flexible shaft comprises a rigid coupler element on at least one end thereof on which said annular element is operatively located.

6. Eccentric screw-type pump according to claim 1, wherein said screw is operatively positively connected to at least one said rotor and said driving shaft.

7. Eccentric screw-type pump according to claim 6, wherein a tensioning distance of said screw corresponds to 0.05 to 0.5 times a diameter of the rotor.

8. Eccentric screw-type pump according to claim 7, wherein said screw includes an annular element on at least one end thereof.

9. Eccentric screw-type pump according to claim 8, wherein said flexible shaft comprises a rigid coupler element on at least one end thereof on which said annular element is operatively located.

10. Eccentric screw-type pump according to claim 6, wherein said screw is maintained under a negative preload in the form of an upset.

11. Eccentric screw-type pump according to claim 10, wherein said screw includes an annular element on at least one end thereof.

12. Eccentric screw-type pump according to claim 11, wherein said flexible shaft comprises a rigid coupler element on at least one end thereof on which said annular element is operatively located.

13. Eccentric screw-type pump according to claim 1, wherein said screw is operatively frictionally or adhesively connected to at least one of said rotor and said driving shaft.

14. Eccentric screw-type pump according to claim 1, wherein said screw is configured from a flat material.

15. Eccentric screw-type pump comprising a pump section having a tubular pump casing, a stator cladding and a pump cavity configured in correspondence with a double-thread or multi-thread screw;

a charge casing;

a drive system; and a screw-type rotor operationally connected to a driving shaft via a flexible shaft;

wherein said flexible shaft is connected by two ends thereof via rigid coupler elements to said rotor and said driving shaft, and said flexible shaft is surrounded by a preloaded coaxially disposed screw, and a tensioning mechanism is arranged to maintain said screw under positive preload in a stretched state, wherein a tensioning distance of said screw corresponds to 0.05 to 0.5 times a diameter of the rotor.

16. Eccentric screw-type pump comprising:

a pump section having a tubular pump casing, a stator cladding and a pump cavity configured in correspondence with a double-thread or multi-thread screw;

a charge casing;

a drive system; and a screw-type rotor operationally connected to a driving shaft via a flexible shaft;

wherein said flexible shaft is connected by two ends thereof via rigid coupler elements to said rotor and said driving shaft, and said flexible shaft is surrounded by a preloaded coaxially disposed screw having ends adjacent each of said rotor and said driving shift, wherein a tensioning distance of said screw corresponds to 0.05 to 0.5 times a diameter of the rotor, and means is provided for maintaining said screw under a negative preload in the form of an upset state.

* * * * *